US005419752A

United States Patent [19]

James et al.

[11] Patent Number: 5,419,752

[45] Date of Patent: May 30, 1995

[54] MUSCLE EXERCISE APPARATUS FOR THE PHYSICALLY DISABLED

[75] Inventors: Jay D. James; Robert Friesen; Michael J. Loeffler, all of Wasilla, Ak.

[73] Assignee: Jockey Cycle, Inc., Wasilla, Ak.

[21] Appl. No.: 57,867

[22] Filed: May 7, 1993

[51] Int. Cl.[6] ..... A61H 1/00

[52] U.S. Cl. ..... 601/5; 482/7; 482/51

[58] Field of Search ..... 482/51, 52, 53, 57-65, 482/79-80, 95-96, 132-138, 6, 7; 128/25 R, 25 B; 601/5

[56] References Cited

U.S. PATENT DOCUMENTS

| | | | |
|---|---|---|---|
| 2,453,771 | 11/1948 | White | 128/25 R |
| 3,596,654 | 8/1971 | Tamura | 128/25 R |
| 4,519,604 | 5/1985 | Arzounian | 128/25 R X |
| 4,700,946 | 10/1987 | Breunig | 128/25 R X |
| 4,844,054 | 7/1989 | Baemdonck | 128/25 R |
| 4,973,046 | 11/1990 | Maxwell | 482/60 |
| 4,986,261 | 1/1991 | Iams et al. | 128/25 R |
| 5,071,117 | 12/1991 | Mautner et al. | 482/57 |
| 5,098,088 | 3/1992 | Cohen et al. | 128/25 R X |

*Primary Examiner*—Richard J. Apley
*Assistant Examiner*—John Mulcahy
*Attorney, Agent, or Firm*—Michael S. Tavella

[57] ABSTRACT

An exerciser for disabled persons has a seat-footrest-arm support system that is driven by a motor and an offset crank drive. This drive works to move the seat and footrest in opposite directions, i.e., when the seat is down, the footrest is up and vice versa. This allows patient to go from a compressed state to a fully extended state during each crank cycle. By securing the patient's arms to stationary support bars, the arms are also similarly flexed and extended during the cycle. The device has speed control to operate at reasonable speeds during the workout. A second embodiment of the invention uses VELCRO covered mitts to secure the patient's hands to a VELCRO covered leg strap. In this way, the patient's arms will follow the movement of the patient's legs.

20 Claims, 11 Drawing Sheets

MUSCLE EXERCISE APPARATUS FOR THE PHYSICALLY DISABLED

This invention relates to muscle exercise apparatus and more particularly to muscle exercise apparatus for physically disabled persons.

BACKGROUND OF THE INVENTION

Due to the nature of their injuries, physically disabled persons, e.g., quadriplegics and paraplegics can not exercise the nonfunctional parts of their bodies. To preserve muscle tone and strength, the large muscle groups must be worked by some external means. These muscles may be worked by a physical therapist who will move the body parts that need work. Many devices have been developed to help in this process. Often, these machines are designed to work specific areas of the body. Examples of these devices can be found in U.S. Pat. Nos. 4,802,462 to Reiss et al., 5,110,121 to Foster, 4,869,494 to Lambert, Sr., 4,976,426 to Szabo, and 4,651,719 to Funk et al. Each of these devices is designed to work a particular muscle group or groups. For example, the Reiss et al. Patent works the lower back. The Szabo Patent is designed to work the legs, arms Or both, depending on the apparatus configuration. Funk et al. is designed to work the shoulder. While these devices perform their intended functions, and because they tend to focus on rehabilitation, they are generally limited to working those specific areas of the body that they were designed.

The present invention overcomes the limitations inherent in these devices to provide a complete workout of the body for a paraplegic. The device has a seat-footrest-arm support system that is driven by a motor and an offset crank drive. This drive works to move the seat and footrest in opposite directions, i.e., When the seat is down, the footrest is up and vice versa. This allows the patient to go from a compressed state to a fully extended state during each crank cycle. By securing the patient's arms to stationary support bars, the arms are also flexed and extended during the cycle. The device has speed control to operate at reasonable speeds during the workout. A second embodiment of the invention uses VELCRO covered mitts to secure the patient's hands to a VELCRO covered leg strap. In this way, the patient's arms will follow the movement of the patient's legs.

It is an object of this invention to produce a muscle exercise apparatus for physically disabled persons that works the entire body of the patient through a single operating mechanism.

It is another object of this invention to produce a muscle exercise apparatus for physically disabled persons that is efficient and economical to build and use.

It is yet another object of this invention to produce a muscle exercise apparatus for physically disabled persons that can be speed controlled in a simple and direct manner.

It is yet another object of this invention to produce a muscle exercise apparatus for physically disabled persons that can be adapted and converted for use by non-disabled persons.

It is yet a further object of this invention to produce a muscle exercise apparatus for physically disabled persons that will provide a complete body workout through even, smooth, nonjarring motion.

BRIEF DESCRIPTION OF THE DRAWINGS

FIG. 14 is a top view of a leg strap with a VELCRO patch to secure the

DETAILED DESCRIPTION OF THE INVENTION

Figure 1:
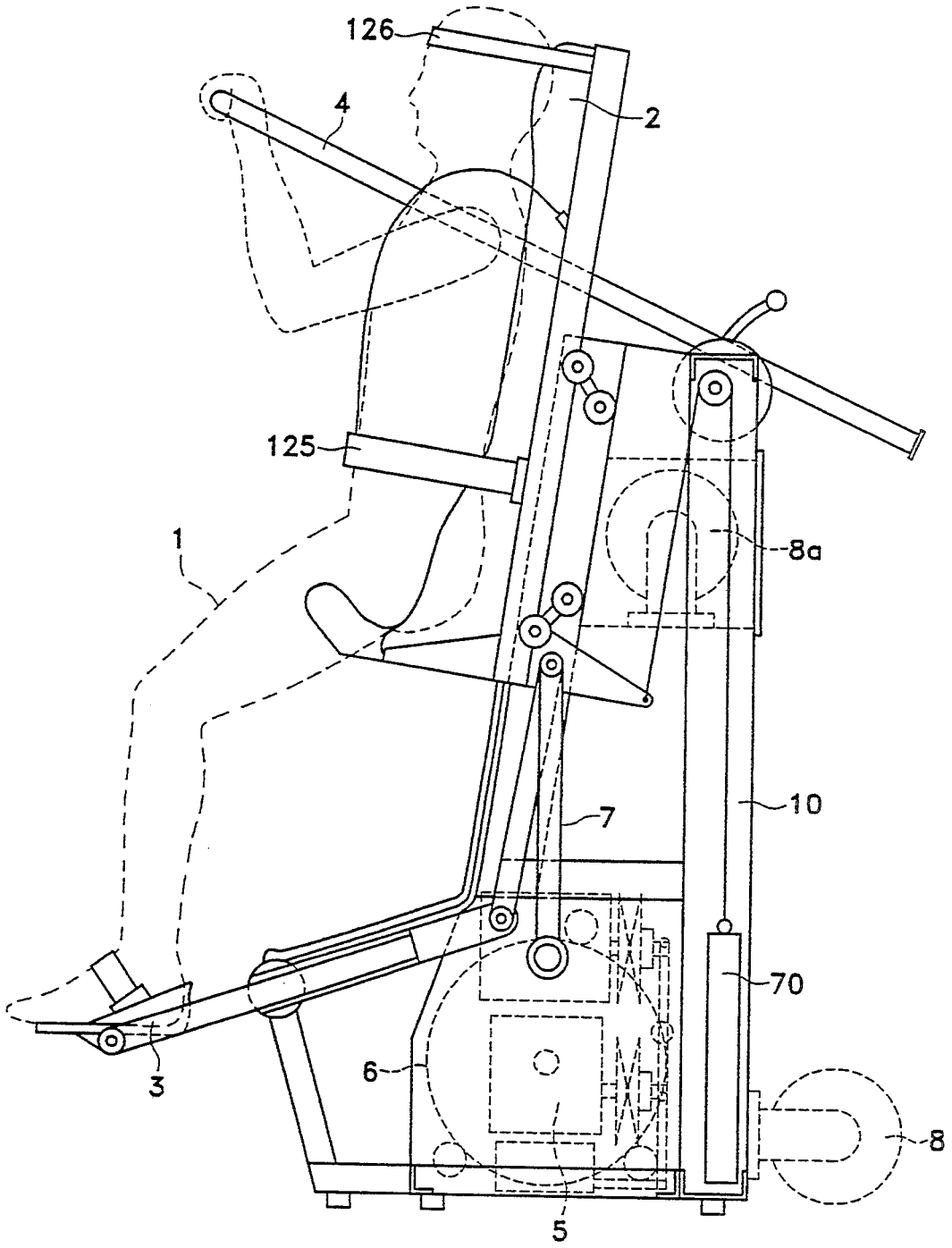
FIG. 1 is a side view of the invention showing the patient in the fully extended position.
Figure 2:
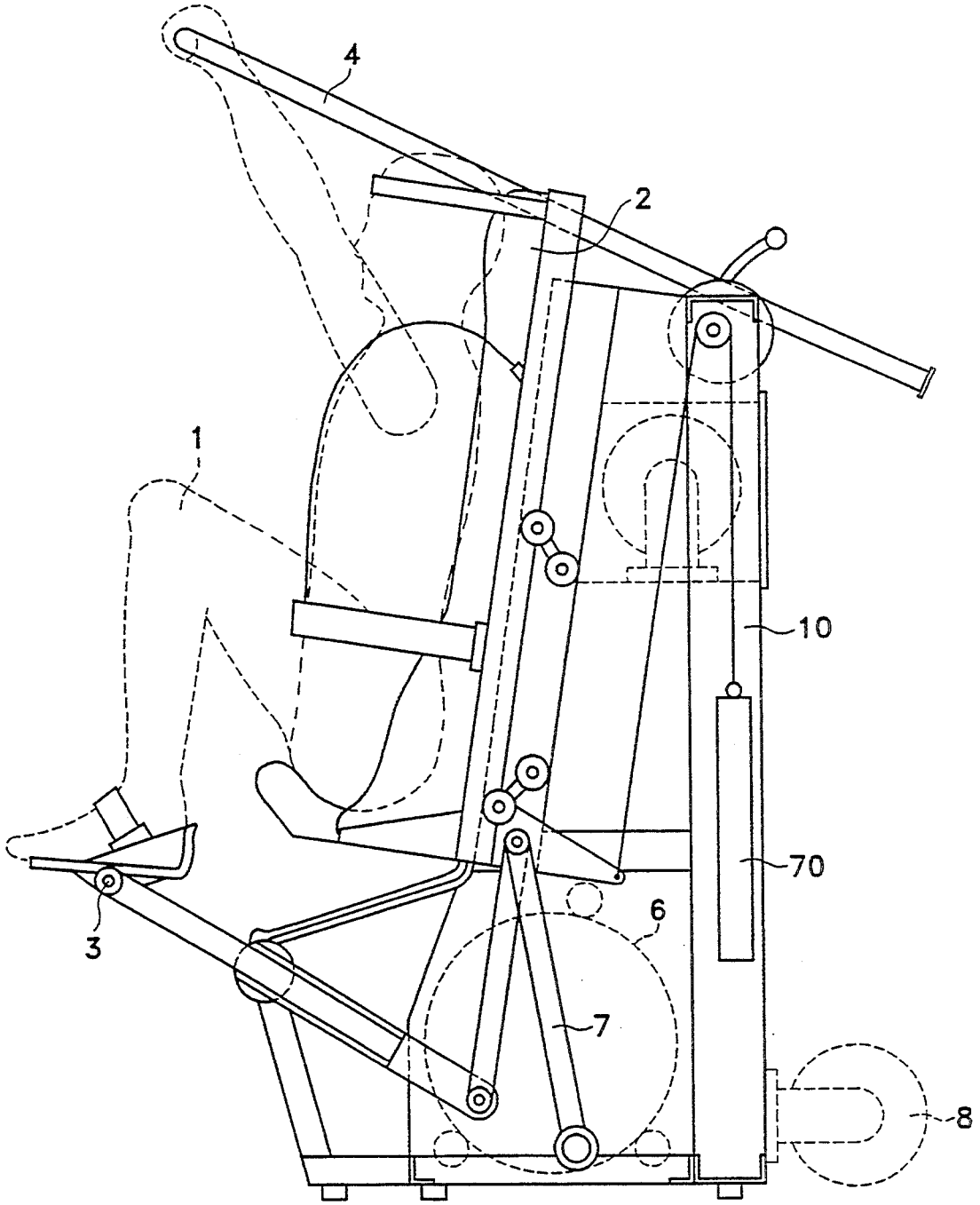
FIG. 2 is a side view of the invention showing the patient in the fully compressed position.
Figure 3:
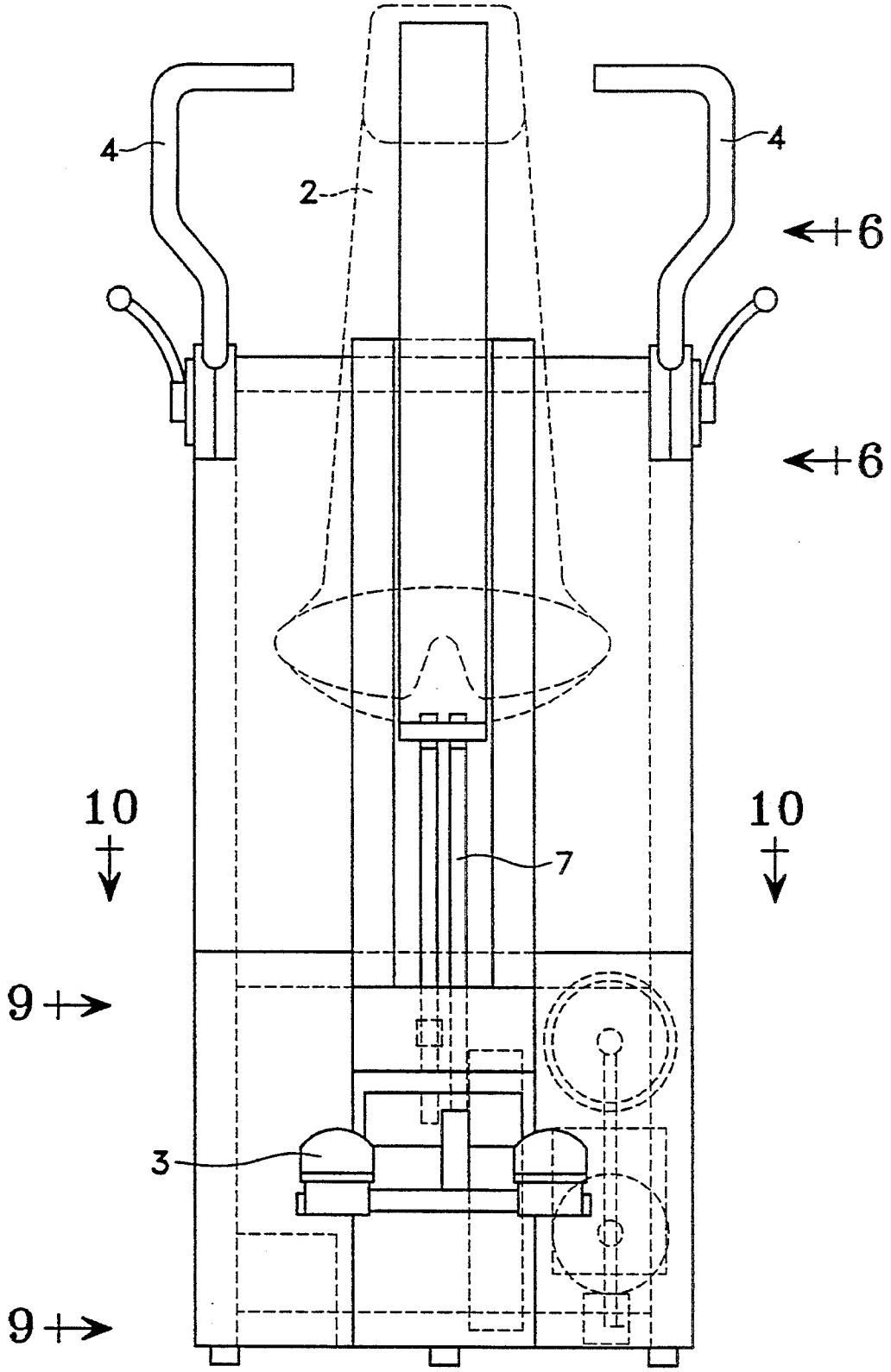
FIG. 3 is a front view of the invention showing the spatial relationships of the seat, footrest and arm support mechanisms.

Referring now to the the drawings, and more particularly to FIGS. 1 and 2, the present invention is an assembly of many different subassemblies. For convenience, each subassembly will be discussed in detail below. The purpose here is to offer a general operational viewpoint to illustrate how the device is intended to be used. FIG. 1 shows the patient 1 seated in the seat 2. The patient's feet are secured in the footrest assembly 3. The patient's arms are secured to the arm support bars 4. The drive assembly 5 turns a flywheel 6 that rotates a rod assembly 7. FIG. 1 shows the rod assembly 7 in the full upright position. In this position, the seat 2 is at its maximum height and the footrest assembly 3 is at its low point. The patient's arms are bent and his legs are extended. FIG. 2 shows the position of the device one-half cycle later. Here, the crank assembly 7 is at the bottom of its rotation. The seat 2 is at the bottom of its travel and the footrest assembly 3 is at the top of its travel. Note that the arm support bars 4 remain in the same position. These bars 4 are not connected to the crank mechanism and are not intended to move with the seat. As will be discussed below, the arm support bars 4 may be adjusted and locked in any position as needed to suit the patient and the specific exercise being performed. In this position, the patient's legs are bent and raised and the patient's arms are fully extended. Over the course of one cycle, the patient 1 will go from the portion in FIG. 1 to the position of FIG. 3 and then back to the position of FIG. 1. In this way, the patient 1 will get an overall body workout through even, smooth, nonjarring motion.

FIGS. 1 and 2 also show Wheels 8 that are used to move the device. The wheels 8 are mounted to the bottom of the frame 10 by bolts, or a wedged channel or by any other means common to the art. When the wheels 8 are in place, the device can be tilted back and moved to a desired location. Once the machine is positioned, the wheels 8 can be removed and stored in a well provided in the frame 10. In this position the wheels are designated as 8*a*.

Figure 4:
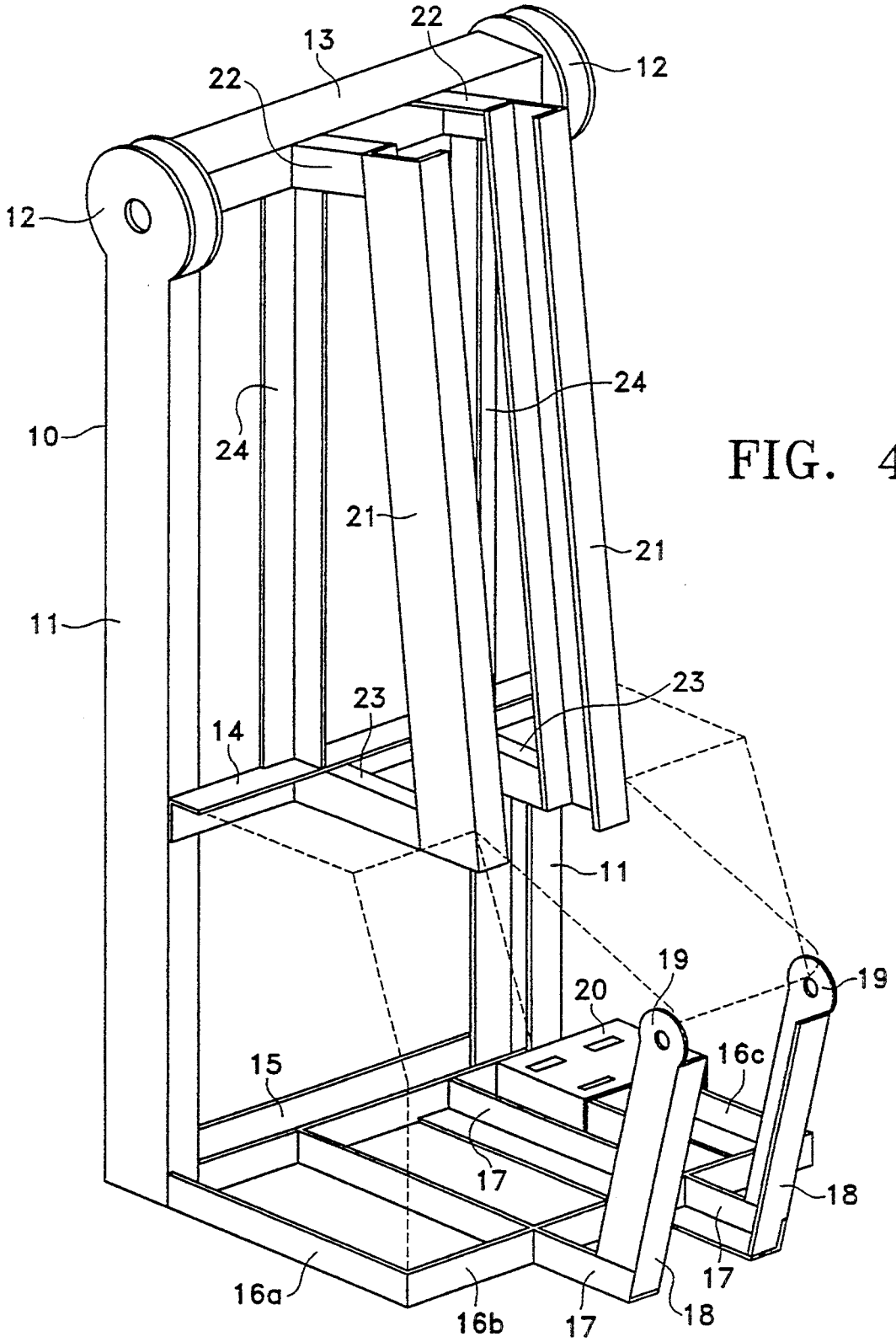
FIG. 4 is an isometric view of the frame.

Referring now to FIG. 4, the foundation of the device is the frame 10. The frame 10 is made up of major support members and secondary supports. Beginning at the back of the frame 1 0, a pair of long vertical support channels 11 are provided. The tops of these channels are fitted with circular portions 12 that are drilled. The circular portions 12 are used to support the arm support assemblies 5, discussed below. The long vertical support channels 11 are connected by three secondary supports 13, 14, and 15. Supports 13 and 15 are formed from channel while support 14 is formed from angle. To provide stability and to connect the foot rest assembly 3, a base 16 is provided. The base 16 has three members, 16*a*, 16*b*, and 16*c*. These members form a rectangular box. Foot rest support angles 17 extend from support 15 through frame member 16*b* as shown. The vertical foot rest supports 18 extend upwardly from supports 17, at an angle as shown. The tops of the vertical foot rest supports 18 are provided with circular members 19 to provide a better surface area for bolting of components and to better act as a pivot point (see below). Also located in the base, is the gearbox mount 20. This mount is used to support the gearbox and drive components, as discussed below.

The seat frame has a pair of channels 21 that are connected to the main frame by two pairs of supports, 22 and 23. Members 22 are shorted than members 23, which produces an angle in the seat support channels 21. This angle is designed necessary to ensure proper spacing of the seat and body position when in operation. Finally, two vertical members 24 are provided as shown. These members provide additional support and further stabilize the device.

Figure 5:
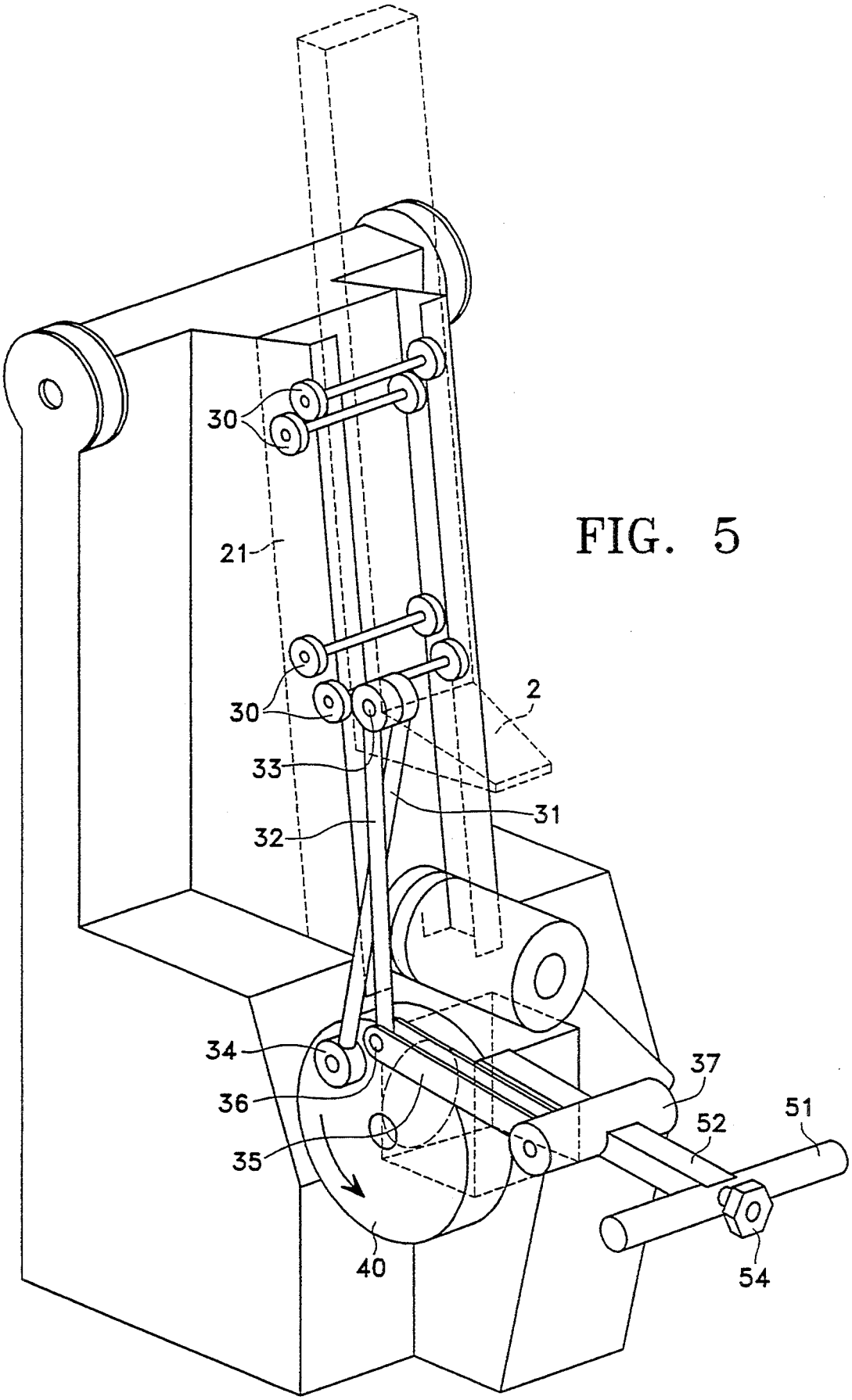
FIG. 5 is an isometric view of the crank-rod assembly.

Referring now to FIG. 5, the seat-foot rest crank rod assembly is shown. The seat 2 is fitted with four pairs of rollers 30. These rollers 30 are placed in the seat support channels 21 (see, e.g., FIG. 1 for a side view of the rollers 30 in the channels 21) and enable the seat 2 to move up and down smoothly. The seat 2 is connected to the rod 31 at the rear pivot point as shown. Connecting rod 32 is also connected at this point by a pin 33 that is passed through both rods.

Figure 8:
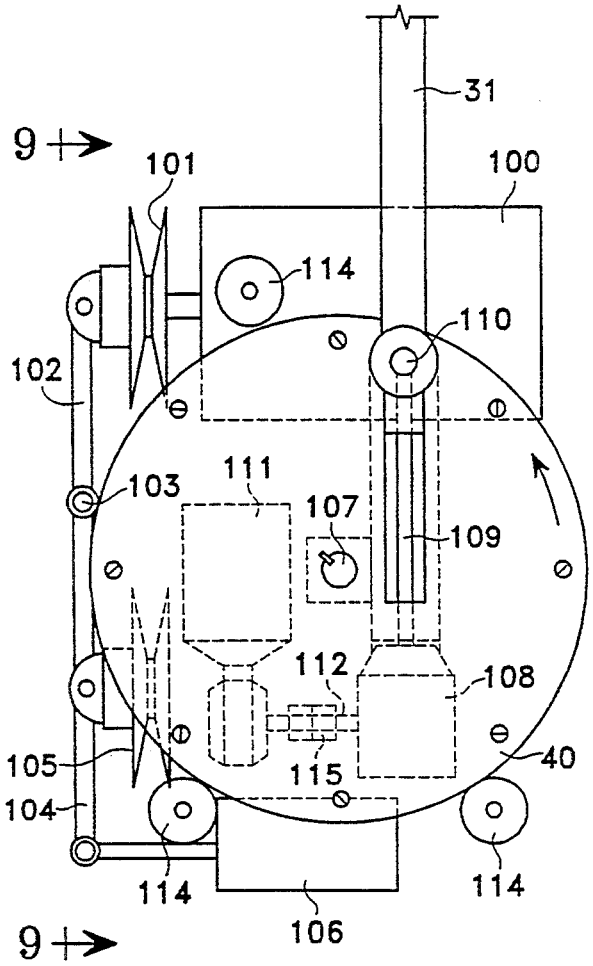
FIG. 8 is a detail view of the actuator screw mechanism.
Figure 9:
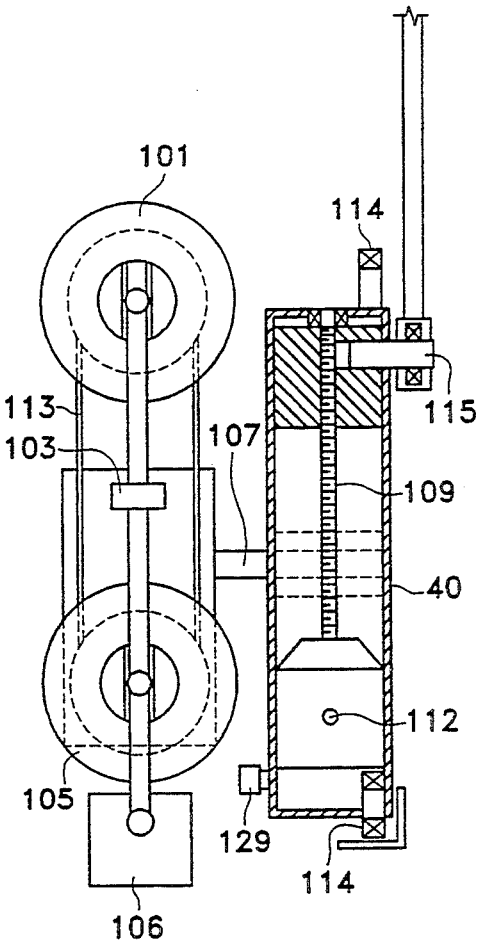
FIG. 9 is a partially cut away side view of the crank mechanism taken along the lines 9—9.

The rod 31 is connected to the flywheel 40 connecting point 34 by a pin, which connects the rod to the actuator screw 50 within the flywheel 40 (see FIGS. 8 and 9). The drive components are discussed in greater detail below. Connecting rod 32 is not connected to the crank, but connects to the foot rest rod 35 by a pin 36. See also FIG. 10. The remainder of the foot rest assembly will be discussed below. As the flywheel 40 turns in the direction shown, the rod 31 moves up and down and moves the seat 2 up and down. Similarly, connecting 32 is also moved up and down. As this rod moves the foot rest rod 35 will cause the foot rest to pivot about the tops 19 of the vertical foot rest supports 18 (see FIG. 4) that causes the footrest to be forced upward or downward in an opposite motion from the connecting rod 32. Thus, when rod 32 is at the bottom of its travel, the foot rest will be at the top of its travel. And when the connecting rod 32 is at the top of its travel, the foot rest will be at the bottom of its travel.

Figure 10:
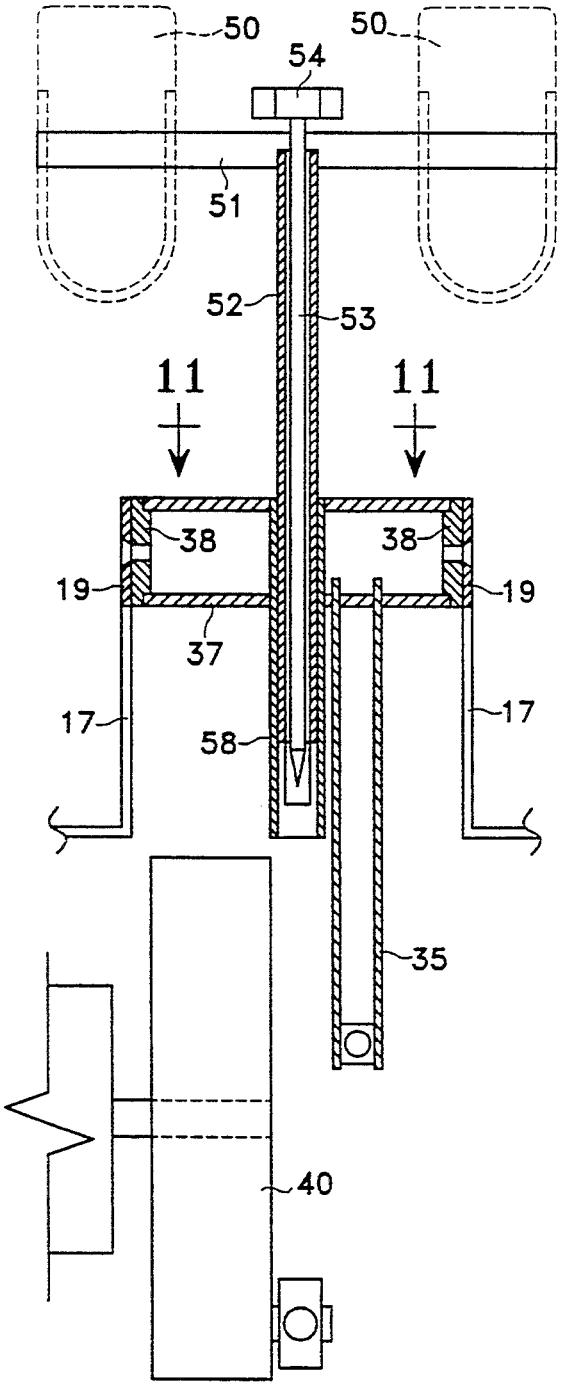
FIG. 10 is a partially cut away top view of the footrest adjustment locking assembly, taken along the lines 10—10.
Figure 12:
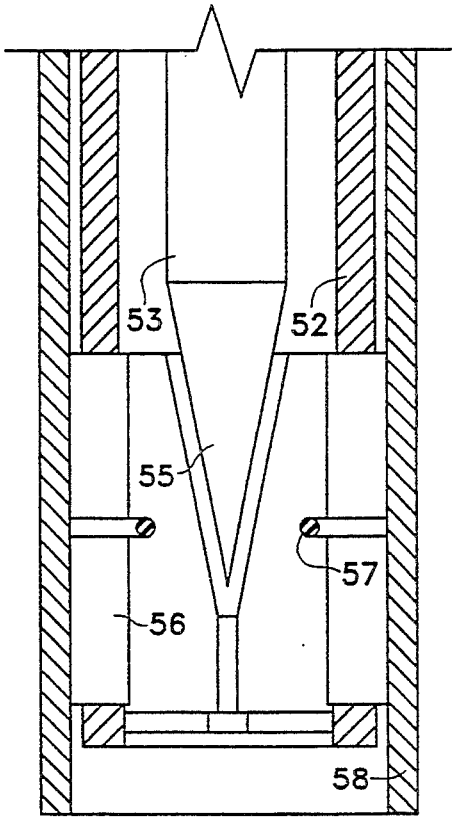
FIG. 12 is a detail view of the end of the footrest adjustment locking assembly.

The other end of the foot rest connecting rod 35 attaches to the foot rest pivot pipe 37. FIG. 10 is a top cutaway view of this detail. The foot rest connecting rod 35 can be welded to the foot rest pivot pipe 37 or fit through slots cut into the foot rest pivot pipe 37. The foot rest pivot pipe 37 is attached to the vertical frame at members 18 at pivot points 19. Spacers 38 are provided to maintain wall strength at the connection points. The foot rest pivot pipe 37 is bolted to pivot points 19 to permit the assembly to turn on these points. The foot rests 50 are formed metal plates shaped to fit normal human feet. Two separate foot rests 50 are provided in the preferred embodiment, however, a single foot rest unit could be substituted. Each foot rest 50 is attached to a foot rest support pipe 51. This connection is designed to permit the footrests to move and pivot as needed for patient comfort. The foot rest support pipe 51 is then connected to a foot rest adjustment channel 52. This channel is square and hollow. One end of the foot rest adjustment channel 52 is fitted with a wedge lock system, which is discussed below. An adjustment bolt 53 The bolt runs the entire length of the foot rest adjustment channel 52 as shown. An adjustment nut 54 is attached to the threaded end of the adjustment bolt 53. The other end of the adjustment bolt is tapered to a point 55 (see FIG. 12). The foot rest adjustment channel 52 is installed by inserting it, with the internal components (discussed below) through a hole cut into the foot rest pivot pipe 37 and into an outer channel 58 (see FIG. 12).

Figure 11:
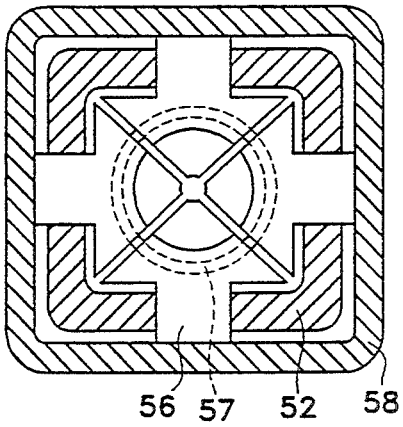
FIG. 11 is a cross-sectional view of the footrest adjustment locking assembly, taken along the lines 11—11.

To secure the foot rest at the desired distance, the point 55 of the adjustment bolt 53 is advanced until it contacts the wedge lock system that is installed within the foot rest adjustment channel 52. The wedge lock system has four wedge shaped members 56 (see FIG. 11) that are held together by an elastic strap 57. The wedges are shaped to fit the point 55 of the adjustment bolt 53. As the bolt is tightened, it is forced into the foot rest adjustment channel 52. This action causes the wedge elements to spread apart against the outer channel 58, thereby preventing movement of the footrest. To adjust the length again, the bolt is backed out of the foot rest adjustment channel 52 until the wedges collapse and the foot rest adjustment channel 52 is free to move.

Figure 6:
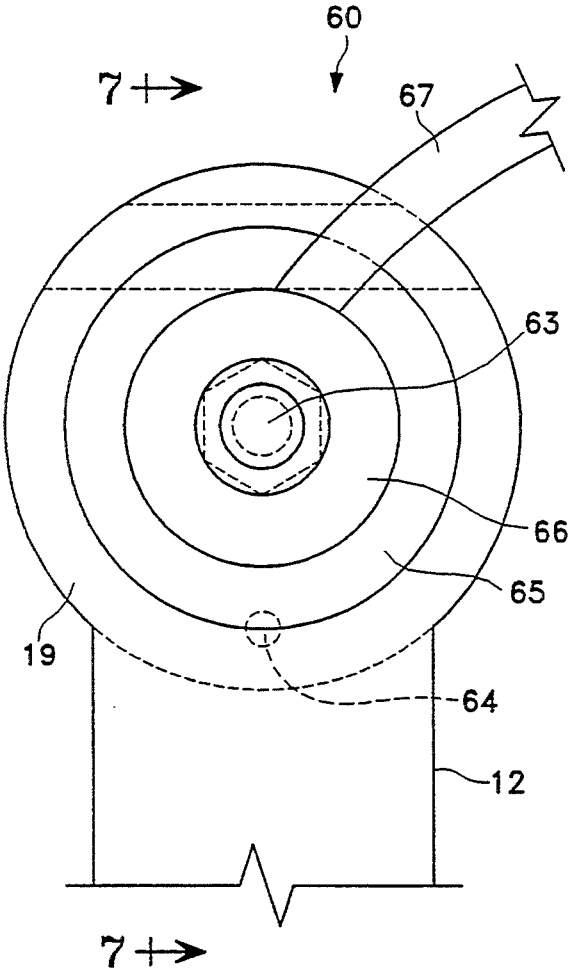
FIG. 6 is the side view of the arm support locking mechanism taken along the lines 6—6.
Figure 7:
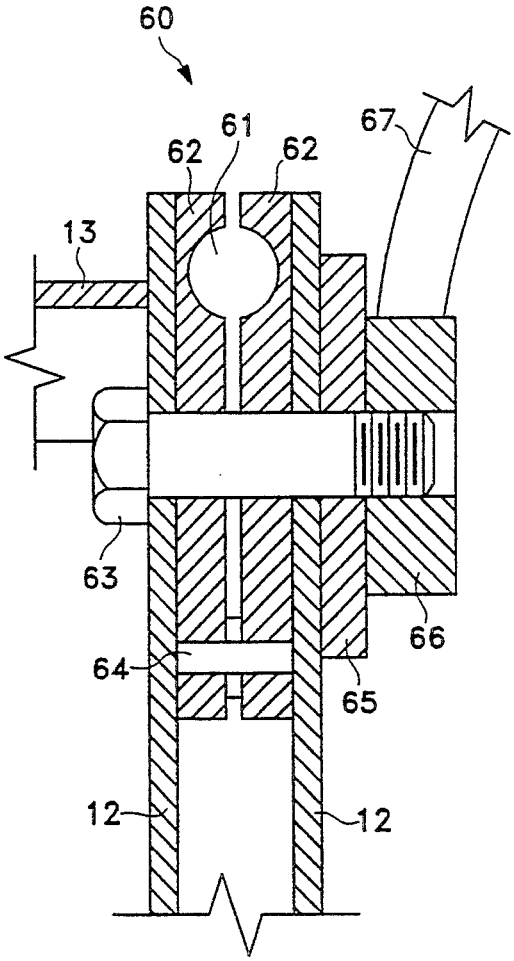
FIG. 7 is a cross-sectional view of the arm support locking mechanism taken along the lines 7—7.

Referring now to FIGS. 6 and 7, the arm support locking mechanism 60 is shown. The arm supports 4 are a pair of shaped rods that extend in an upward angle (see FIG. 1) and are curved to provide hand holds (see FIG. 3). The arm supports 4 are connected to the device through the arm support locking mechanism 60. FIG. 7 shows a cross section of the arm support locking mechanism 60. The arm supports 4 pass through an opening 61 formed in aluminum clamp blocks 62. These clamp blocks 62 are transverse drilled to permit a locking bolt 63 and an alignment pin 64 to pass through the blocks 62 as shown. FIG. 7 shows the right side of the device (looking from the front) thus, support bar 13 is shown extending from the left. The left arm support locking mechanism 60 is identical, but reversed. Members 12 of the frame are also shown. Thus, the aluminum clamp blocks 62 are fitted between the ends of the member 12. The locking bolt 63 is used to secure the arm supports 4 in position. It passes through the aluminum clamp blocks 62 and the member 12 as shown. A spacer washer 65 is used to provide a solid support base for the locking nut 66. Locking nut 66 is connected to a locking handle 67 as shown. The locking handle 67 provides a convenient means to loosen and tighten the locking bolt 63. For example, once the arm supports 4 are in position, the locking handle 67 can then be turned to tighten the locking bolt 63. As bolt 63 becomes tighter, the aluminum clamp blocks 62 press against the arm support bar 4 until the bar cannot be moved. To readjust the arm support bars 4, the locking handle is turned in the opposite direction to loosen the locking bolt 63 sufficiently to release the clamp blocks 62. Once the arm support bar has been adjusted, the process can be reversed to lock it back into place.

Referring now to FIGS. 8 and 9, the details of the drive mechanism are shown. FIG. 8 is a front view showing a cross section of the flywheel 40. Support bearings 114 for the flywheel 40 are provided as shown. The unit is powered by a drive motor 100. The output shaft of the drive motor 100 is connected to a first pulley 101. Pulley 101 is connected by a pivot shaft 102 to a pivot point 103. A connecting rod 104 connects to the gear pulley 105. The connecting rod 104 continues down to a servo control 106. The servo operates a variable speed belt drive 106, which is a common type of speed control transmission to the art. The gearbox must be sized to the output speed of the drive motor 100. For example for a motor having an output speed of 1150 rpm, a 120:1 reduction gearbox would be used. The output shaft of the gearbox 107 is then connected to the center of the flywheel 40 using standard bearings.

The stroke distance of the connecting rod 31 is also mechanically controlled. Of course, stroke adjustments may be made in any number of ways, such as providing spaced mounting holes on the flywheel 40 and adjusting the position of the connecting rod 31 as needed. Although this method works, it cannot be performed While the machine is in motion. Thus, adjustment would require starting and stopping the machine. The preferred embodiment uses electrical controls to adjust the stroke length while the machine is running. The connecting rod 31 is connected to a 5:1 ratio actuator screw at pin 110. The actuator screw has two main:parts a drive 108 and a worm screw 109. As the drive 108 turns the worm screw 109, the connecting rod will move up or down as needed. The lower down on the flywheel 40 the connecting rod 31 sits, the shorter the stroke (the distance the seat and foot rest will travel). In the preferred embodiment, the stroke can be adjusted from four inches to 12 inches using the actuator screw. For a person standing six feet tall, the 12 inch stroke is ideal.

The actuator drive 108 is turned by a 12 volt gear motor 111 that is mounted in the flywheel 40. Note that FIG. 9 does not show the gear motor for clarity of that view. The gear motor 111 connects to the actuator drive 108 at the shaft 112 through coupler 115 (see FIG. 8).

Power is supplied to the gear motor by copper contact rings that are attached to the outer face of the flywheel 40. A set of brushes 129 feeds both positive and negative 12 volt supply as well as a ground lead.

Figure 16:
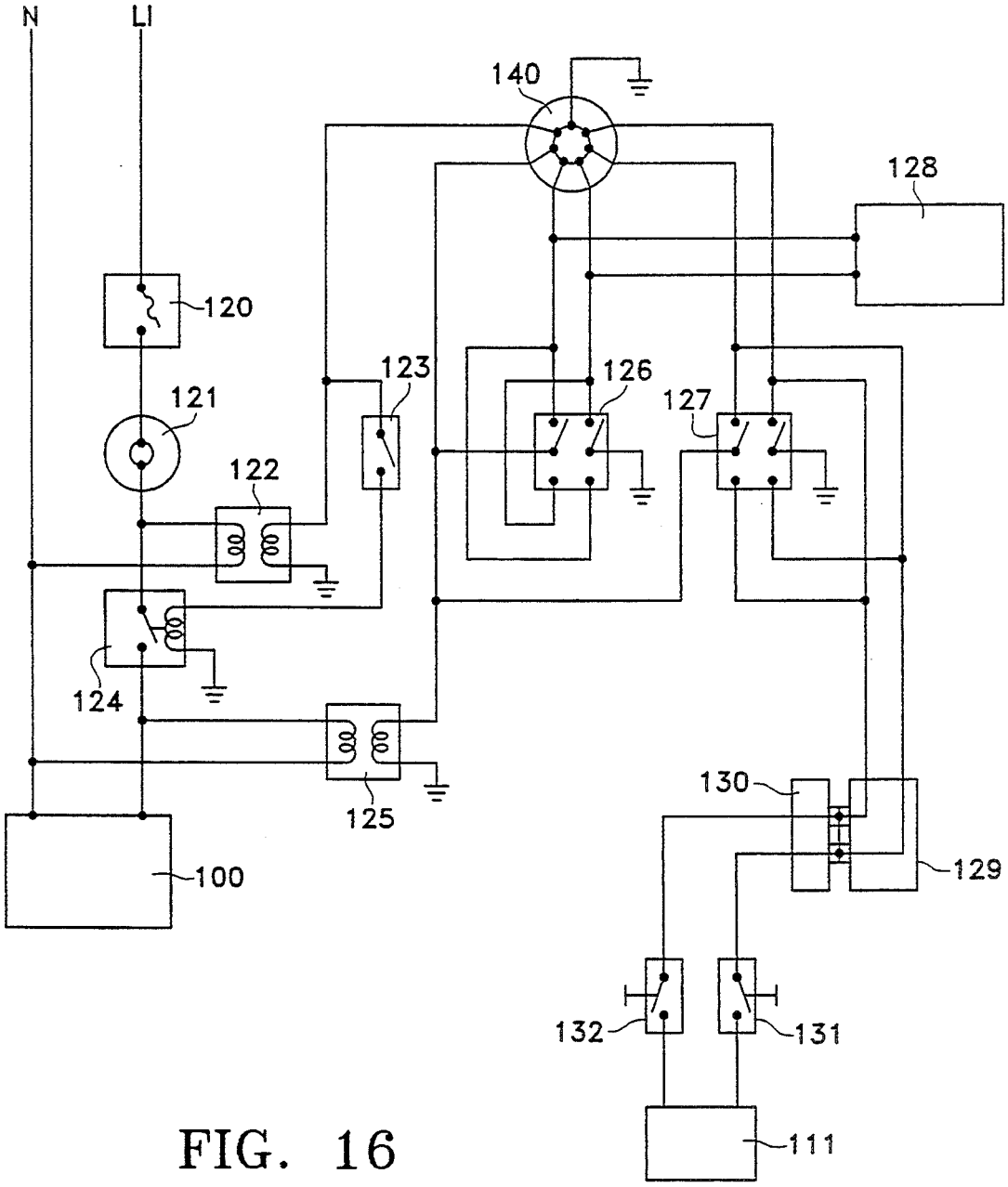
FIG. 16 is a schematic block diagram of the electrical control system for the device.

The electrical controls are shown in a schematic form in FIG. 16. The device is powered by a 120 volt source through a master switch 120 that contains circuit breaker protection. An optional 60 minute timer 121 can be connected to the power supply and is so connected in the preferred embodiment. A first 120 volt to 12 volt power supply 122 is then connected. The 12 volt output of this supply is connected to single pole single throw motor switch 123. Switch 123 then connects to the coil of a motor start relay 124. The relay 124 has a single set of normally open contacts that connect a 120 volt input to the drive motor 100 and a second 120 v to 12 volt power supply 125. When switch 123 is thrown, the coil of relay 124 is energized, starting the drive motor 100. Power is also routed through power supply 125 to switches 126 and 127. Switch 126 is a double pole double throw 12 volt switch that activates the servo motor 128 enabling speed control. Switch 127 supplies power to the brush sets 129 and the copper pick up rings 130, to power the gear motor 111 and the actuator screw for stroke adjustment. Limit switches 131 and 132 can be added if needed to control the extent of movement.

FIG. 16 also shows a plug 140 that can be used to attach a remote control box. The control circuits terminate in the plug and the matching hand held unit (not shown) will operate the device as desired.

The motor 100, in the preferred embodiment, is ½ horse power. It is designed to provide ample torque to drive the device, but must be designed to limit possible over torque that could cause injury to the user. To counter act the reduced motor size, a counter weight 70 is provided (see FIGS. 1 and 2 ) to provide smooth operation of the seat and footrest.

Referring now to FIG. 1, several accessories are shown. The device may be moved with the aid of Wheels 8. These wheels are mounted at the back of the frame designated as 8*a* on the figure. The wheels may be bolted in place or may be held in place by a wedge bracket formed on the frame. When the wheels are no longer needed, they can be removed and stored in the upper part of the frame (designated as 120*b*) in the figure.

The user can be secured to the device by a strap 125 that is fitted about the user's waist. A head strap 126 also can be used to prevent unwanted head movement.

Figure 13:
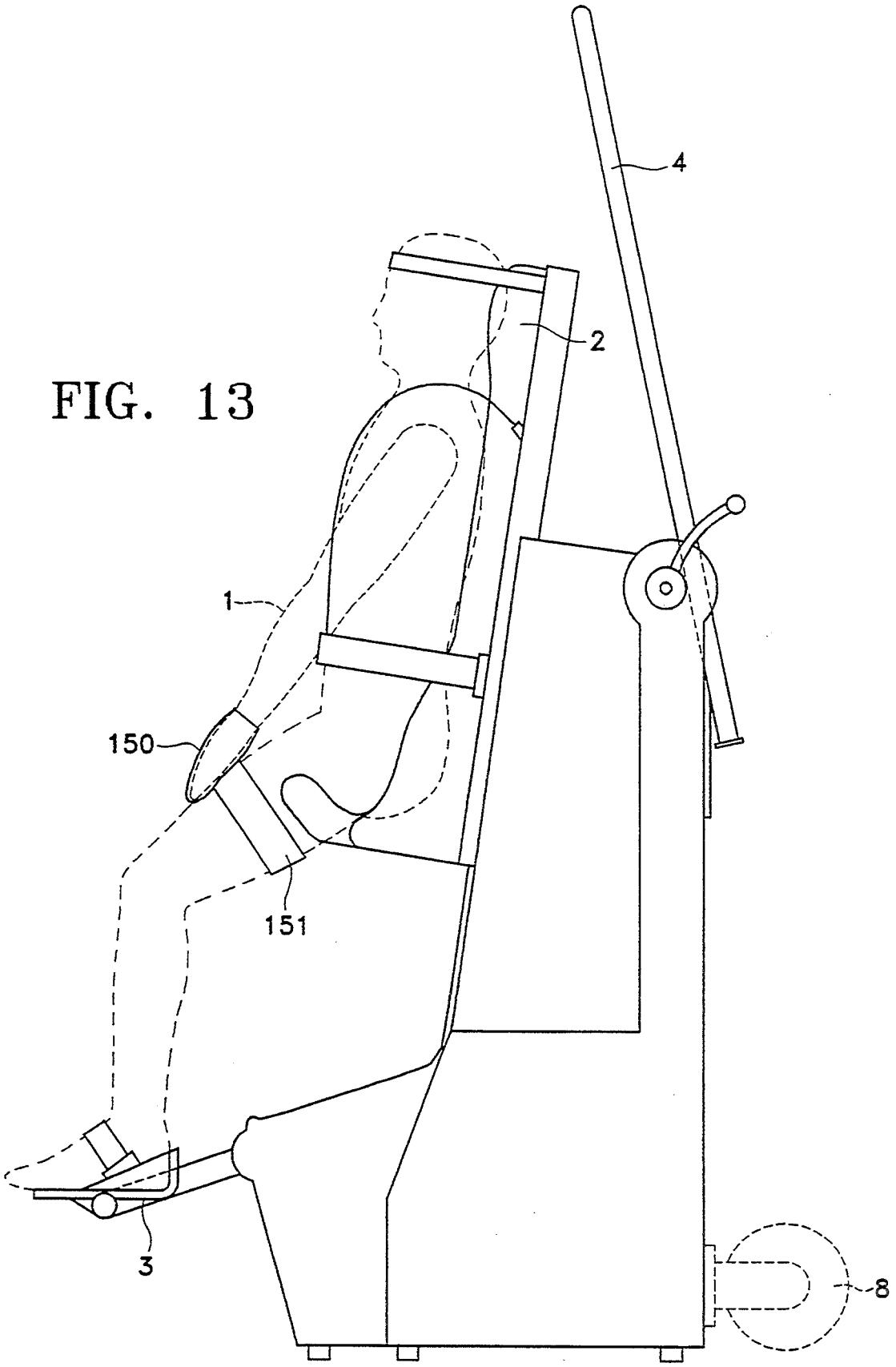
FIG. 13 is a side view of the invention showing use of the VELCRO mitts to secure the patient's hand to his legs.
Figure 14:
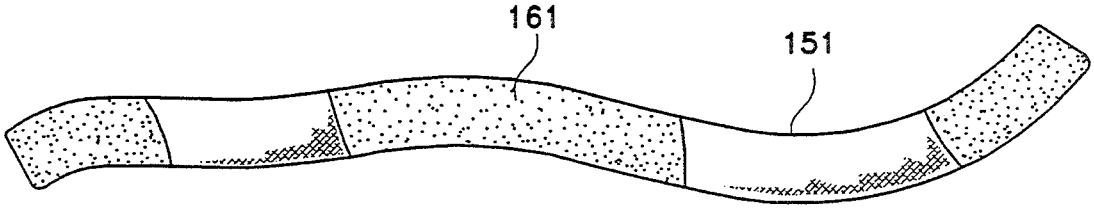
Figure 15:
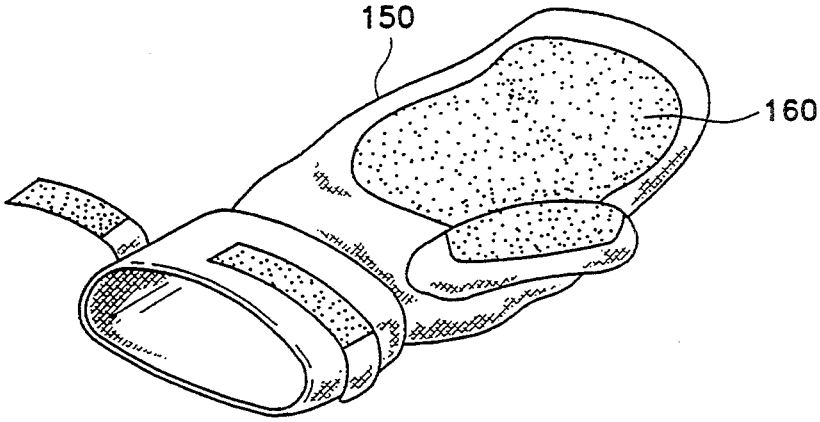
FIG. 15 is a perspective view of a VELCRO mitt.

Referring now to FIGS. 13, 14 and 15, an alternative method of placement for the hands is shown. In this embodiment, the hands are fitted with mitts or gloves 150 covered with VELCRO 160 (see FIG. 15). The user is then fitted with a thigh strap 151 that is also covered with a patch of VELCRO 161 (see FIG. 14). In use, the mitts or gloves are attached to the thigh strap 151 as shown in FIG. 13. Here, the arms are extended. As the cycle continues and the legs are brought up, the arms will flex, providing a thorough workout. Note that when this embodiment is in use, the arm supports 4 are retracted and moved out of the way.

The mitts or gloves 150 can be also used with the arm supports. In this embodiment the arm support handles would be covered with VELCRO and the mitts would be stuck to this material.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A powered exercise machine comprising:

a) a frame;

b) a seat, slidably attached to said frame;

c) a foot rest, pivotably attached to said frame, said footrest having a flat, unitary surface such that a user's feet are positionable adjacent on said foot rest;

d) an offset crank means;

e) a first connecting rod means to connect said seat to said offset crank means;

f) a second connecting rod means to connect said footrest to said seat, thereby permitting the footrest to be moved in an opposite orientation to said seat such that when the seat is propelled upwards by the first connecting rod means, said footrest will be propelled downwards and when said seat is propelled downwards, said footrest is propelled upwards, said foot rest being designed to move both feet placed thereon in the same plane and in substantially the same direction and g) drive means to turn said crank means.

2. The powered exercise machine of claim 1 further comprising arm support means adjustably attached to said frame.

3. The powered exercise machine of claim 2 wherein said arm support means comprise:

a) a pair of rods slidably attached to said frame;

b) hand grip means attached to one end of said rods; and c) means to lock said rods in a particular position for use.

4. The powered exercise machine of claim 1 further comprising speed control means to control the speed of the drive means.

5. The powered exercise machine of claim 1 further comprising means to control the extent of movement of said first and second connecting rod means thereby controlling the extent of movement of said seat and said footrest.

6. The powered exercise machine of claim 5, wherein said means to control the extent of movement of said first and second connecting rod means can be adjusted while the offset crank means is in motion.

7. The powered exercise machine of claim 6 wherein said means to control the extent of movement while the offset crank means is in motion comprise:

a) an actuator motor;

b) a worm screw drive means connected to said actuator motor, said worm screw drive means being fixedly attached to said first connecting rod means; and c) means to control said actuator.

8. A powered exercise machine comprising:

a) a frame;

b) a seat, slidably attached to said frame;

c) a foot rest, pivotably attached to said frame, said footrest having a flat, unitary surface such that a user's feet are positionable adjacent on said foot rest;

d) an offset crank means;

e) a first connecting rod means to connect said seat to said offset crank means;

f) a second connecting rod means to connect said footrest to said seat, thereby permitting the footrest to be moved in an opposite orientation to said seat such that when the seat is propelled upwards by the first crank means, said footrest will be propelled downwards and when said seat is propelled downwards, said footrest is propelled upwards, said foot rest being designed to move both feet placed thereon in the same plane and in the same direction as the movement of the footrest;

g) drive means to turn said crank means; and h) speed control means to control the speed of the drive means i) arm support means adjustably attached to said frame.

9. The powered exercise machine of claim 8 wherein said arm support means comprise:

a) a pair of rods slidably attached to said frame;

b) hand grip means attached to one end of said rods; and c) means to lock said rods in a particular position for use.

10. The powered exercise machine of claim 8 further comprising speed control means to control the speed of the drive means.

11. The powered exercise machine of claim 8 further comprising means to control the extent of movement of said first and second connecting rod means thereby controlling the extent of movement of said seat and said footrest.

12. The powered exercise machine of claim 11 wherein said means means to control the extent of movement of said first and second connecting rod can be adjusted while the offset crank means is in motion.

13. The powered exercise machine of claim 12 wherein said means to control the extent of movement while the offset crank means is in motion comprise:

a) an actuator motor;

b ) a worm screw drive means connected to said actuator motor, said worm screw drive means being fixedly attached to said first connecting rod means; and c) means to control said actuator.

14. A powered exercise machine for people comprising:

a) a frame;

b) a seat, slidably attached to said frame;

c) a foot rest, pivotably attached to said frame, said footrest having a flat, unitary surface such that a user's feet are positionable adjacent on said foot rest;

d) an offset crank means;

e) a first connecting rod means to connect said seat to said offset crank means;

f) a second connecting rod means to connect said footrest to said seat, thereby permitting the footrest to be moved in an opposite orientation to said seat such that when the seat is propelled upwards by the first crank means, said footrest will be propelled downwards and when said seat is propelled downwards, said footrest is propelled upwards, said foot rest being designed to move both feet placed thereon in the same plane and in the same direction as the movement of the footrest;

g) drive means to turn said crank means; and h) speed control means to control the speed of the drive means;

i) hand attachment means placed over the hands of a person using said exercise machine, said hand attachment means have holding means fixedly attached; and j) a strap removably connected to said seat, said strap being designed to fit across a person's thighs when the machine is in use, said strap also having attachment means fixedly attached to said strap to permit attachment of said hand attachment means.

15. The device of claim 14 wherein said hand attachment means are mittens.

16. The device of claim 14 wherein said hand attachment means are gloves.

17. The powered exercise machine of claim 14 further comprising means to control the extent of movement of said first and second connecting rod means thereby controlling the extent of movement of said seat and said footrest.

18. The powered exercise machine of claim 17 wherein said means to control the extent of movement of said first and second connecting rod can be adjusted while the offset crank means is in motion.

19. The powered exercise machine of claim 18 wherein said means to control the extent of movement while the offset crank means is in motion comprise:

a) an actuator motor;

b ) a worm screw drive means connected to said actuator motor, said worm screw drive means being fixedly attached to said first connecting rod means; and c) means to control said actuator.

20. The device of claim 14 wherein said holding means on hand attachment means comprises a hook and loop fastener.

* * * * *